United States Patent [19]

Johnston

[11] 4,195,873

[45] Apr. 1, 1980

[54] LIFTING DEVICE

[75] Inventor: Ronald J. Johnston, Georgetown, Canada

[73] Assignee: Aluma Systems Incorporated, Downsview, Canada

[21] Appl. No.: 928,409

[22] Filed: Jul. 27, 1978

[30] Foreign Application Priority Data

Jul. 21, 1978 [CA] Canada ..... 307870

[51] Int. Cl.[2] ..... B66C 1/64

[52] U.S. Cl. ..... 294/106

[58] Field of Search ..... 294/16, 82 R, 83 R, 294/85, 78 R, 104, 106, 110 R, 117, 118; 104/258; 238/327 A, 359; 248/228

[56] References Cited

U.S. PATENT DOCUMENTS

| | | | |
|---|---|---|---|
| 673,356 | 4/1901 | Brittain | 294/118 |
| 1,150,581 | 8/1915 | Delan | 294/106 X |
| 1,580,083 | 4/1926 | Boadle | 294/104 |
| 2,013,621 | 9/1935 | Beal et al. | 294/104 X |
| 3,572,808 | 3/1971 | Miller | 294/118 |
| 3,632,152 | 1/1972 | Renfroe | 294/82 R X |

*Primary Examiner*—Johnny D. Cherry
*Attorney, Agent, or Firm*—Donald E. Hewson

[57] ABSTRACT

A lifting device for use in association with concrete forming structures is provided. The lifting device has a pair of jaws, mounted on an axle, with a lifting lug associated with one of the jaws and a handle associated with the other of the jaws so that the other jaw may be hingedly moved relative to the first jaw. A spring loaded locking pin is provided to lock the second jaw in either an open or closed position, relative to the first position. The locking pin and the handle are each operable from above the lifting device. The inner ends of each of the hook-like jaws are rounded so as to specifically match the root configuration between the web and top flange of an upper chord of a truss, or other component of a concrete forming structure intended to be lifted using the lifting device of the present invention.

5 Claims, 4 Drawing Figures

LIFTING DEVICE

FIELD OF THE INVENTION

This invention relates to a lifting device, particularly a lifting device which is adapted to co-operate with truss members or other members of concrete forming structures when lifting the same for purposes of relocating by a crane (i.e. "flying") such concrete forming structures from one working position to another working position at a job site.

BACKGROUND OF THE INVENTION

Flying forms and other concrete forming structures which are basically intended to be moved from one working position at a job site to another working position are particularly taught in P. J. Avery, U.S. Pat. No. 3,899,152 issued Aug. 12, 1975—relating particularly to horizontal concrete forming structures—and also in R. J. Johnston, U.S. Pat. No. 4,033,544 issued July 5, 1977—relating particularly to vertical or wall forming structures—both of which Patents are assigned to a common assignee with this application.

Especially when concrete forming structures are to be "flown", it has been the usual practice to pick up the structure by passing slings around the top chord of each of the trusses of the concrete forming structure. The slings are secured to cables which are suspended from a crane for lifting the structure.

However, previously used slings have had a number of disadvantages. For example, wire slings cause damage to the top cords of the trusses; and nylon slings wear out. Most especially, the previously used slings have generally required two men to install them on the trusses, one of whom may be required to work beneath the truss. Another previous method has consisted of using a fixed lifting lug, requiring two, three or four such lugs per panel. Thus, on a project having, say, 20 panels, up to 80 fixed lugs are required; as opposed to only four lifting devices according to this invention, notwithstanding the number of panels being used.

The need for use of a releasable clamp or grab as a lifting device, which could be operated from above, locked in both an open and closed position when desired or believed necessary, and which is sufficiently strong as to be able to withstand the load, becomes apparent. F. B. Harley, in U.S. Pat. No. 3,588,970 issued June 29, 1971, has provided a releasable clamp for attaching stays or guy wires to a framework scaffold, or for lifting a tube, rod or bar. The clamp has opposite handed hoods which receive the circular cross section of the item to be secured or lifted, between them. However, there is no positive arrangement for locking the hooks in an open position; and in any event, they have no substantial length, and provide a total wrap around the item being secured.

E. D. Butz, in U.S. Pat. No. 3,718,362 issued Feb. 27, 1973, provides a hoist for lifting loads, where a pair of claws are automatically closed on to such as the underside of the flange of a beam or the like. However, the device operates to have automatic closing parts which close when the load is to be lifted and release the load when the load is put down. Inadvertant release of the load from the hoist may occur, and there is no positive securement of the hoist against the load until such time as the lifting operation has substantially begun.

Y. Kawaguchi, in U.S. Pat. No. 3,942,834, issued Mar. 9, 1976, has taught a grab or hoist which has two arms connected at their upper ends to a pantograph, in such a manner that simply by lifting and lowering a ring at the top of the pantograph, the arms of the device can be closed and opened thereby permitting engagement with and disengagement from, a load such as a steel beam. The disadvantages are similar to those referred to above with respect to the Butz device.

U.S. Pat. No. 3,958,825, issued May 25, 1976, to I. Diamond, relates to a beam clamp which has a pair of arms loosely fitted to a ring. Jaws are adapted in the arms, either to fit the upper and lower flanges of the beam against which they tighten as the ring is lifted, or to fit under the top flanges of a beam. In either event, however, there is no locking arrangement of the arms of the beam clamp to the beam until at least a lifting operation has begun.

BRIEF SUMMARY OF THE INVENTION

The present invention consists of a lifting device which has a pair of jaws, each with an inwardly turned hook-like configuration; an axle on which each of the pair of jaws is mounted and to which one of the pair of jaws is secured so that the jaws have a hinged relationship to each other; a lifting lug associated with a first one of said pair of jaws; and a handle associated with the other of said pair of jaws. The lifting device of the present invention is particularly characterized in that the inwardly turned hook-like configurations of the jaws have rounded tips at their inner ends, which tips are approximal each other when the jaws are in their respective closed positions; in that the tips are located at below the axle and the lifting lug is located above the axle; in that the length of each of the jaws is substantially co-extensive along their entire lengths; and in that the lifting handle situated on the one of the pair of jaws which does not have the lifting lug associated with it, so that when the lifting lug is substantially vertical, the second of the pair of jaws having the handle can be manipulated and moved in accordance with its hinged relationship with the other jaw from a closed to an open position, and vice versa.

The present invention provides a lifting device such as that described above, which is particularly adapted to be manufactured from extruded aluminum sections, and which is particularly adapted for lifting concrete forming structures.

A principle object of this invention is, therefore, to provide a lifting device for use with concrete forming structures which can be safely and easily operated, with a positive co-operating relation of the lifting device with the load being lifted.

BRIEF DESCRIPTION OF THE DRAWINGS

The above-referred to lifting device, the advantages and features thereof, are more particularly described hereafter in association with the accompanying drawings, in which.

Figure 1:
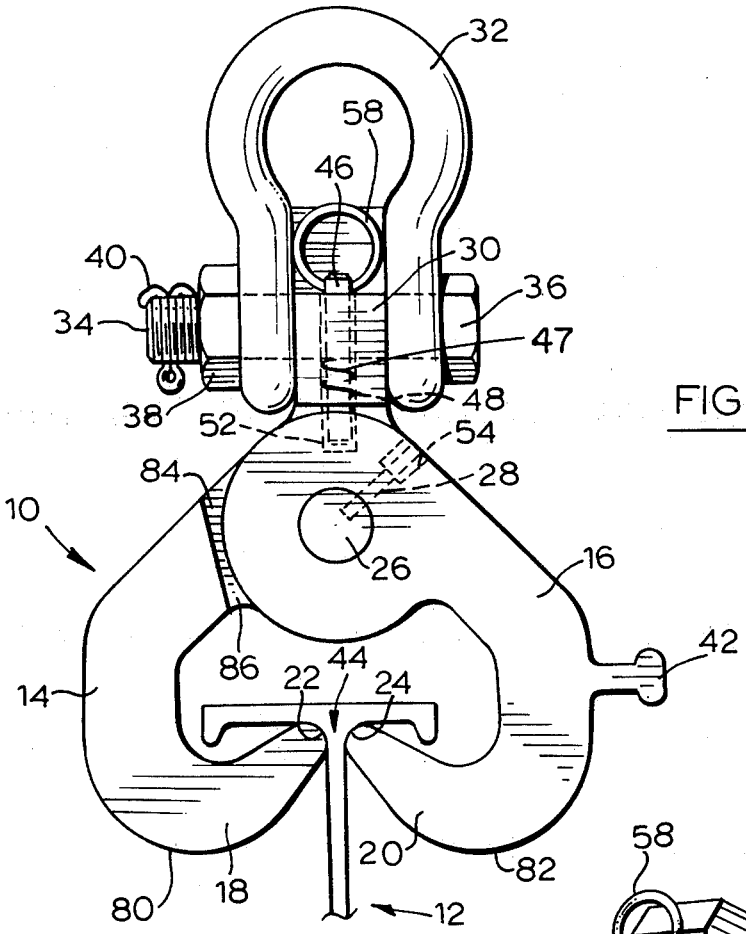
FIG. 1 shows the lifting relationship of a lifting device according to this invention relative to a truss member of a truss to be lifted.

DESCRIPTION OF THE PREFERRED EMBODIMENTS:

The lifting device is shown in FIG. 1 generally with the reference number 10. The lifting device is shown to be co-operating with a load which, in this instance, is represented by a number 12 which is a component of a concrete forming structure, usually a structural member of a truss as discussed hereafter.

The lifting device comprises a pair of jaws 14 and 16, each of which has a inwardly turned hook-like configuration with hook ends 18 and 20 respectively and tips 22 and 24 respectively.

The jaws 14 and 16 adapted to have a hinged relationship with each other. This is accomplished by their relationship to axle 26, with one of the jaws being secured to the axle 26 and the other arranged to rotate about the axle. Usually, the jaw 16 is secured to the axle 26 by way of a pin 28, such as a split pin. Thus, jaws 14 and 16 have a hinged relationship to each other, with the jaw 16 capable of moving with respect to the jaw 14 in the manner discussed hereafter, and with the axle 26 rotatable in a suitable bore formed in the jaw 14.

A lifting lug 30 is associated with the jaw 14. Thus, load which is supported by the lifting lug 30 transfers directly to the jaw 14 and through the axle 26 to the jaw 16. A shackle 32 may be associated with the lifting lug 30, by means of a bolt 34 having a head 36, nut 38 and cotter pin 40 securing the same in place. The shackle 32 and the bolt 34 may be ordinary high strength forged steel shackles and bolts known to the industry.

A handle 42 is associated with the jaw 16. Manipulation of the handle, subject to the locking device discussed hereafter being inoperative, will thereby cause the hinging change of position of the jaw 16 relative to the jaw 14.

As so far described, it will be noted that when the jaws 14 and 16 are substantially closed, the tips 22 and 24 are opposed to each other and are in a relative position one with respect to the other such that the web/-flange root area 44 of the member 12 is fitted between the tips 22 and 24. Indeed, in the preferred embodiments where the lifting device 10 is particularly adapted to be used with trusses of concrete forming structures supplied by the assignee of the present invention, which trusses have top and bottom chords which may have a configuration such as that indicated in FIG. 1, the radiuses of the tips 22 and 24 are determined so that they substantially fit the web/flange area 44 of the member, such web/flange roots of the structural member being similarly radiused in the root area.

It should be noted that the structural member of a truss, having the configuration indicated at FIG. 1, may be reversed with respect to the lifting device 10; or, more properly, the lifting device 10 may be reversed with respect to the structural member. That is, there is no "right way" or "wrong way" to mount the lifting device to the structural member. In the configuration shown, the load transfer from the structural member to the lifting device is at approximately 45° to the web, so that the load is substantially taken up in the web/flange root area of the member. In any event, the force transfer is at the web/flange root, rather than in the flanges—and especially not at the outer edges of the flanges—thereby substantially precluding the risk of damage to the structural member such as flange buckling.

Figure 2:
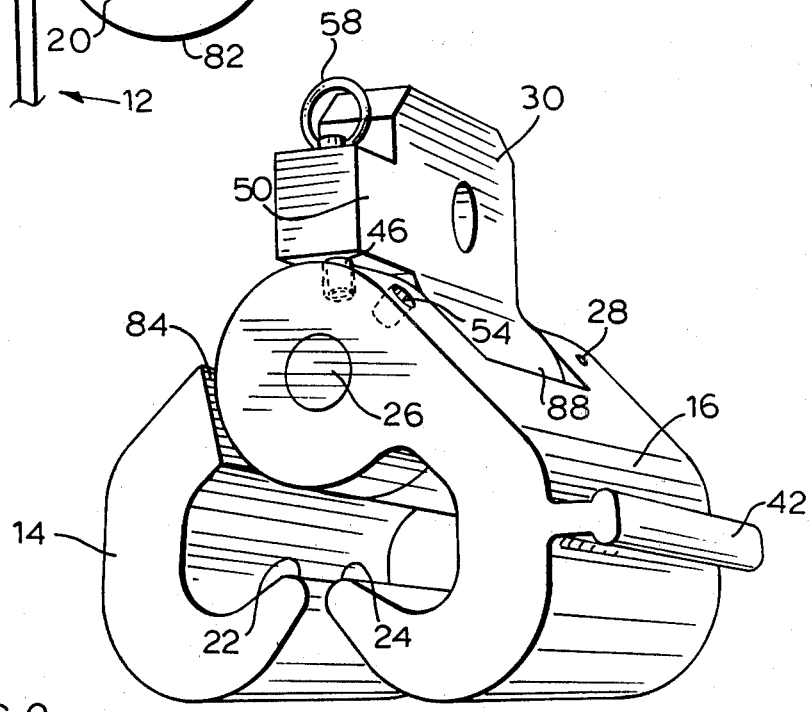
FIG. 2 is a perspective view of the lifting device with the jaws in a closed position.
Figure 3:
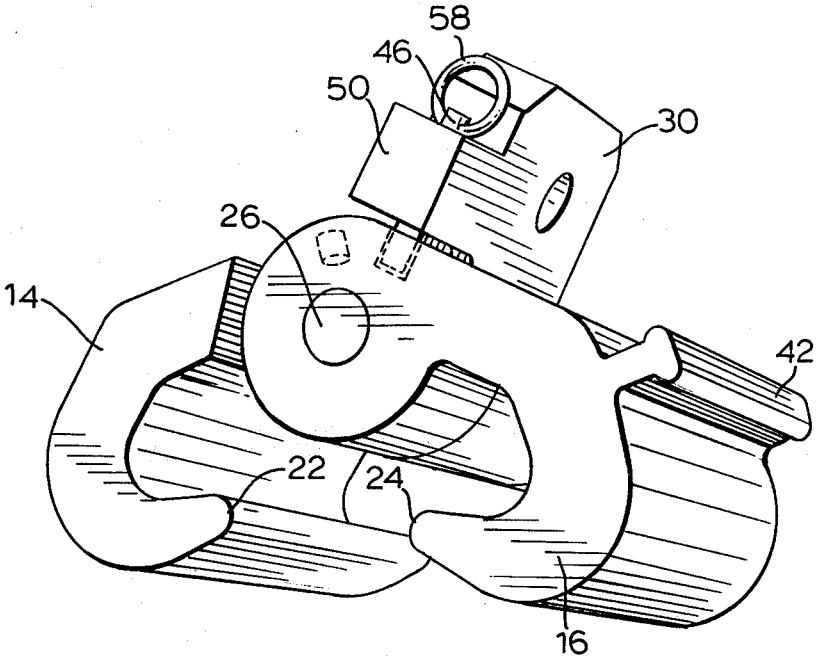
FIG. 3 is a perspective view of the lifting device with the jaws in an open position.

As indicated in FIGS. 2 and 3, each of the jaws 14 and 16 has a length which is substantially equal to each other. Thus, the tips 22 and 24 are substantially co-extensive along their entire lengths, particularly as indicated in FIG. 2.

It is preferred that the lifting device of the present invention have a locking means so that the jaws 14 and 16 may be locked in either of an open or closed position with respect to each other. The locking device may conveniently comprise a pin 46 which may be urged downwardly by a spring 47 and which is movable in a bore 48. The locking device is particularly conveniently located when it is placed in an extension 50 of the lifting lug 30, and is arranged to extend into either of two recesses 52 and 54 formed in the jaw 16. When the pin 46 extends into the recess 52, the jaws 14 and 16 are locked together in a closed position; and when the pin 46 extends into the recess 54, the jaws 14 and 16 are locked together in an open position. The pin 46 may be withdrawn against the spring load which maintains it in either of the recesses into which it extends, by pulling on a split ring 58. It will be seen, therefore, that when the pin extends through the extension 50 into either of the recesses 52 or 54, the pin is operable from above the lifting device 10. It is therefore much less likely to be damaged, and does not require access from beneath.

The lock could, of course, be located in a different position; and may, for example, be arranged so that a pin could be movable to secure or lock the relative positions of the jaws 14 and 16 relative to the axle 26, by extending therefrom.

Figure 4:
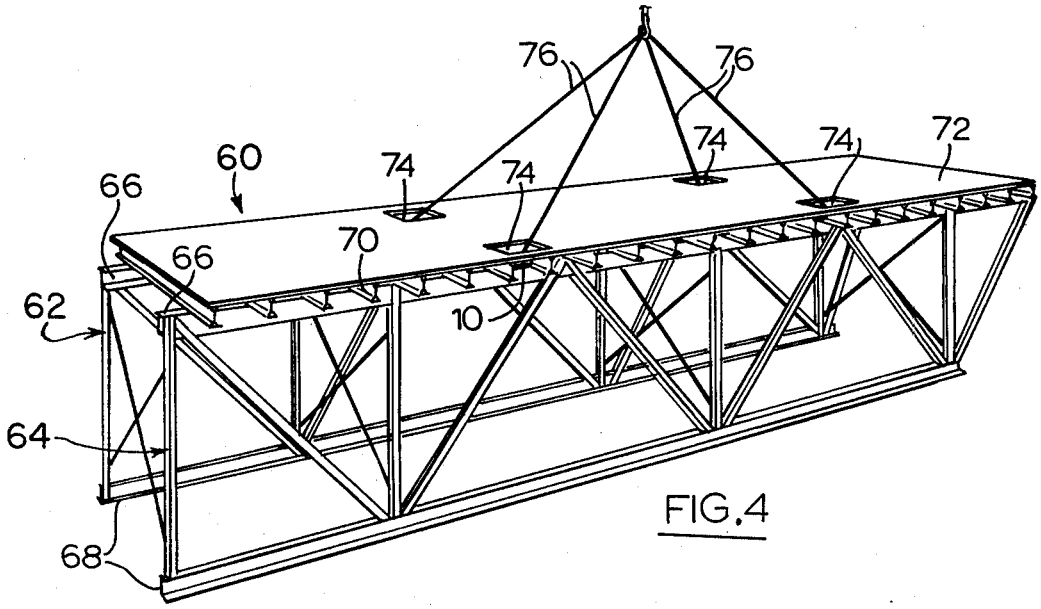
FIG. 4 is a view showing a truss being lifted using lifting devices according to this invention.

Reference to FIG. 4 shows a concrete forming structure generally designated at 60. That concrete forming structure comprises a pair of trusses 62 and 64, each of which has a top chord 66 and a bottom chord 68, respectively. A plurality of beams 70 are secured across the top chords 66, and the decking 72 is secured to the beams 70. When it is intended that the concrete forming structure 60 be moved from a first position to a second position by "flying" the same, covers or ports 74 are removed from the decking 72, and a lifting device 10 is inserted downwards through each of the ports 74 and secured to either the top chords 66 or the bottom chords 68, but usually to the top chords 66. Cables 76 are secured to the lifting devices 10, and are suspended from a crane for lifting the concrete forming structure 60, the crane having sufficient capacity to carry the weight of the concrete forming structure 60.

Thus, it can be seen that a workman can position himself on the decking 72, and simply by reaching down from above, he can unlock the pin 46 by withdrawing it from the recess in which it may have extended, thereby permitting a hinged movement of the jaw 16 with respect to the jaw 14. The lifting device 10 can, therefore, be secured to the top chords 66, or be removed from the top chords, by a single man working from above.

The jaws 14 and 16 are formed of extruded aluminum, and it will be noted that extruded aluminum is much less brittle than cast aluminum.

It should be noted that, when the lifting lug 30 is in a vertical position, the jaws can be opened with respect to each other simply by manipulation of the jaw 16 by securing the handle 42 and lifting on the same.

The ability to be able to lock the jaws in both an open and closed position provides for greater safety and greater acceptance, in the field, by workmen and more assurance to them of the safety of the devices and of the ease and speed by which they may be installed.

The relative lengths of the jaws 14 and 16, as compared with substantially flat hooks or arms such as those particularly shown in the Harley and Diamond Patents referred to above assures a more rigid structure with better load transfer characteristics.

The use of extruded aluminum provides the advantages of relative lightness of the lifting device, and durability of the device.

There has been described above a lifting device which is particularly adapted for use in association with concrete forming structures. The lifting device is such that it can be operated from above by one man, and may be conveniently locked in either an open or closed position. Modifications and amendments to the disclosed embodiments may be made, however, without departing from the spirit and scope of the appended claims.

I claim:

1. A lifting device for use in association with concrete forming structures, comprising:

(a) a pair of jaws, each have an inwardly turned hook-like configuration;

(b) an axle on which each of said pair of jaws is mounted and to which one end of one of said pair of jaws is secured so that said pair of jaws have a hinged relationship to each other;

(c) a lifting lug associated with a first one of said pair of jaws;

(d) a handle associated with the second of said pair of jaws;

said lifting device being characterized in that:

(i) said inwardly turned hook-like configurations of said jaws have rounded tips at the inner end of each said jaw, which tips are proximal to each other when said jaws are in their closed positions;

(ii) said tips are below said axle, and said lifting lug is above said axle;

(iii) the length of each of said jaws is substantially equal to each other, so that said tips are substantially co-extensive along their entire lengths and (iv) the lengths of said jaws and of said axle are all substantially equal to each other, and are all substantially greater than the diameter of said axle.

2. The lifting device of claim 1, further including:

(e) locking means comprising a pin moveable in a bore formed in one of said pair of jaws and adapted to extend into one of two recesses formed in the outer surface of the other of said pair of jaws and urged by means of a spring downwardly into either of said recesses, so that said pair of jaws can be locked in an open or a closed position with respect to each other.

3. The lifting device of claim 2 where said bore in which said pin is moveable is formed in an extension of said first of said pair of jaws, so that it is operable from above said axle.

4. The lifting device of claim 1 where said pair of jaws are each formed of extruded aluminum, and said lifting lug and handle are formed together with the respective first and second ones of said pair of jaws.

5. The lifting device of claim 1 where the second of said pair of jaws is secured to said axle.

* * * * *